US005816549A

United States Patent [19]

Anderson

[11] Patent Number: 5,816,549

[45] Date of Patent: Oct. 6, 1998

[54] BRACKET ASSEMBLY FOR AFFIXING A PAINT ROLLER TRAY TO A PAINT BUCKET

[76] Inventor: Charles E. Anderson, 1976 Latham Rd., National City, Mich. 48748

[21] Appl. No.: 824,556

[22] Filed: Mar. 25, 1997

[51] Int. Cl.[6] ..... A47B 96/06

[52] U.S. Cl. ..... 248/213.2; 248/210; 248/211

[58] Field of Search ..... 248/211, 210, 248/110, 213.2, 354.1, 354.3

[56] References Cited

U.S. PATENT DOCUMENTS

| | | | |
|---|---|---|---|
| D. 173,189 | 10/1954 | Clark, Sr. . | |
| 2,184,460 | 12/1939 | Linder | 248/110 |
| 2,625,299 | 1/1953 | Uhlig | 220/90 |
| 2,698,450 | 1/1955 | Mack . | |
| 2,911,663 | 10/1959 | Geary . | |
| 3,897,722 | 8/1975 | Harris | 99/345 |
| 3,980,264 | 9/1976 | Tomasik | 248/210 |
| 4,266,746 | 5/1981 | Klaiber | 248/113 |
| 4,700,830 | 10/1987 | O'Brien | 206/229 |
| 4,949,864 | 8/1990 | LaKier | 220/90 |
| 5,052,581 | 10/1991 | Christ et al. | 220/570 |
| 5,062,607 | 11/1991 | Kisner | 248/211 |
| 5,085,386 | 2/1992 | Hicks et al. | 248/110 |
| 5,472,111 | 12/1995 | Renfrew | 220/570 |
| 5,511,279 | 4/1996 | Ippolito | 15/257.06 |

*Primary Examiner*—Leslie A. Braun
*Assistant Examiner*—Kimberly Wood
*Attorney, Agent, or Firm*—Tom Hamill, Jr.

[57] ABSTRACT

A bracket assembly for securing a paint roller tray to a paint bucket is provided. The bracket includes a cradle for receiving a paint tray in an angled relation above the bucket. The cradle is centrally fixed atop a first rod, the first rod having a top and a bottom portion. The top portion includes a securing element to secure the paint tray to the cradle. The bottom portion includes a rectangular support element which is affixed centrally and perpendicularly to the bottom portion of the first rod. Intermediate the top portion and the bottom portion is an U-shaped cover which is nested in a downward fashion atop the first rod. The cover has a pair of legs affixed thereto in parallel relation which straddle the rim of the bucket. The legs depend downwardly from intermediate the two lips of the cover. The legs are secured to the lips. A first leg remains outside the bucket, is adjustable in height, and acts as a stabilization support for the main portion of the bracket. The second leg remains inside the bucket and with the first leg acts as a yoke about the rim. A securing element is provided on the first leg, which fixes the bracket to the bucket. A spacer element is provided on the bottom of the first leg to bias the first leg against the bucket. A pair of feet depend from the bottom of the first leg to provide stabilization when the device is employed.

10 Claims, 5 Drawing Sheets

BRACKET ASSEMBLY FOR AFFIXING A PAINT ROLLER TRAY TO A PAINT BUCKET

BACKGROUND OF THE INVENTION

1. Field of the Invention

The present invention relates generally to bracket assemblies and more particularly to a bracket assembly for affixing a paint roller tray above a standard multi-gallon, cylindrical paint bucket.

2. Description of the Prior Art

It has been well known that the use of paint rollers increases the capacity of one to apply paint or other coatings (such as sealants) to surfaces. It is traditional to provide a paint roller tray, and to pour the coating from its separate bucket into the tray. The roller is then placed in the poured coating and rolled back and forth in the tray which applies the coating evenly on the roller. The roller is then employed in a well known manner. When the coating is exhausted from the tray, it must be refilled. This is inefficient and time consuming, especially during large scale jobs. A 5 gallon plastic bucket is the commercially accepted standard for the sale of paints, coatings, and sealants for larger scale jobs. As such it is desirable to create a system which would permit a 5 gallon bucket of coating to be completely utilized without the step of pouring the paint from the bucket into the tray.

Devices which attach to paint buckets have been known in the art. U.S. Pat. No. 5,472,111 issued to Renfrew discloses a non-standard paint roller tray designed to be affixed to the top of a rectangular paint bucket. The tray also may act as a lid for the rectangular pail. There is no bracket associated with this device, the tray has been modified to cooperate with the handles located on the rectangular pail.

U.S. Pat. No. 2,698,450 issued to Mack discloses a paint roller tray being affixed to the top of a standard bucket. The tray includes a aperture through the bottom through which the paint roller may be passed to access the paint. The tray substantially covers the pail. The tray is secured to the bucket by fasteners which interact with the former pail handle interface.

U.S. Des. 173,189 discloses a paint brush holder. A bracket assembly is hooked over the rim of the bucket to permit a paint brush to be rested thereon when not being used. There is no teaching of affixing a convention paint roller tray to the assembly.

Thus, while the foregoing body of prior art indicates it is known to use paint roller trays in combination with paint buckets, the provision of a bracket assembly for holding a paint roller tray which may be affixed to a standard 5 gallon paint container is not contemplated. Nor does the prior art described above teach or suggest a stabilizing leg to prevent the tippage of such a paint container when the paint supply in the container is near exhaustion. The prior art does not show a standard paint tray in angled relation above a standard paint container, which would permit the paint container itself to be used as a paint reservoir and thus obviate having to pour paint into the paint roller tray. The foregoing disadvantages are overcome by the unique bracket assembly of the present invention as will be made apparent from the following description thereof. The use of a stabilizing leg which interfaces with the ground, along with the placement of the tray atop the bracket to permit easy access of the roller to the paint pail clearly is advantageous. Other advantages of the present invention over the prior art also will be rendered evident.

SUMMARY OF THE INVENTION

A bracket for securing a paint roller tray to a coating reservoir is provided. This will permit a painter to more efficiently apply coating during large scale jobs. It has a yoke which affixes a bracket to the coating reservoir, such as a standard 5 gallon, cylindrical paint bucket. The bracket holds a paint roller tray in angled relation above the reservoir. The paint roller tray is located with the lower angled portion atop the opening of the reservoir and any excess coating which may be found on the paint roller tray will drain into the reservoir. The laborer will place a coating applicator in the first reservoir, entrain the coating on the surface of the applicator, wipe the excess coating off on the paint roller tray, and apply the coat to the desired surface. This permits the laborer to easily utilize all the coating in the reservoir without stopping. The bracket includes a stabilizing leg which prevents the reservoir from tipping when the coating supply falls below a critical value.

The bracket also includes a cradle for receiving a paint tray in an angled relation above the bucket. The cradle is centrally fixed atop a first rod, the first rod having a top and a bottom portion. The top portion includes means to secure the paint tray to the cradle. The bottom portion includes a rectangular support element which is affixed centrally and perpendicularly to the bottom portion of the first rod. Intermediate the top portion and the bottom portion is an U-shaped cover which is nested in a downward fashion atop the first rod. The cover has a pair of legs affixed thereto in parallel relation which straddle the rim of the bucket. The legs depend downwardly from intermediate the two lips of the cover. The legs are secured to the lips. A first leg remains outside the bucket, is adjustable in height, and acts as a stabilization support for the main portion of the bracket. The second leg remains inside the bucket and with the first leg acts as a yoke about the rim. A securing element is provided on the first leg, which fixes the bracket to the bucket. A spacer element is provided on the bottom of the first leg to bias the first leg against the bucket. A pair of feet depend from the bottom of the first leg to provide stabilization when the device is employed.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is an object of the present invention to provide a bracket assembly for affixing a standard paint roller tray to a multi gallon paint bucket which includes a cradle for holding the tray above the bucket in an angled relation.

It is therefore an object of the present invention is to provide a bracket assembly for affixing a standard paint roller tray to a multi gallon paint bucket which includes means to prevent the paint bucket from tipping.

It is another object of the invention to provide a bracket assembly for affixing a standard paint roller tray to a multi gallon paint bucket where the bracket is placed in such a manner above the paint bucket to permit the paint roller to freely enter and exit the bucket.

It is another object of the invention to provide a bracket assembly for affixing a standard paint roller tray to a multi gallon paint bucket with an adjustable stabilization leg to permit the bracket assembly to be affixed to paint buckets of different heights.

It is another object to the invention to provide a bracket assembly for affixing a standard paint roller tray to a multi gallon paint bucket which may be attached and removed from the paint bucket in a simple fashion.

It is therefore an object of the present invention to provide a bracket assembly for affixing a standard paint roller tray to a multi gallon paint bucket which has all of the advantages of the prior art and none of the disadvantages.

It is another object of the present invention to provide a bracket assembly for affixing a standard paint roller tray to a multi gallon paint bucket which may be easily and efficiently manufactured and marketed.

It is a further objective of the present invention to provide a bracket assembly for affixing a standard paint roller tray to a multi gallon paint bucket which is of durable and reliable construction, where the assembly may be substantially constructed of plastic or metal.

An even further object of the present invention is to provide a bracket assembly for affixing a standard paint roller tray to a multi gallon paint bucket which is susceptible of a low cost of manufacture with regard to both materials and labor, and which accordingly is then susceptible of low prices of sale to the consuming public, thereby making such a bracket assembly for affixing a standard paint roller tray to a multi gallon paint bucket available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a bracket assembly for affixing a standard paint roller tray to a multi gallon paint bucket embodying the principles and concepts of the present invention will be described.

Figure 1:
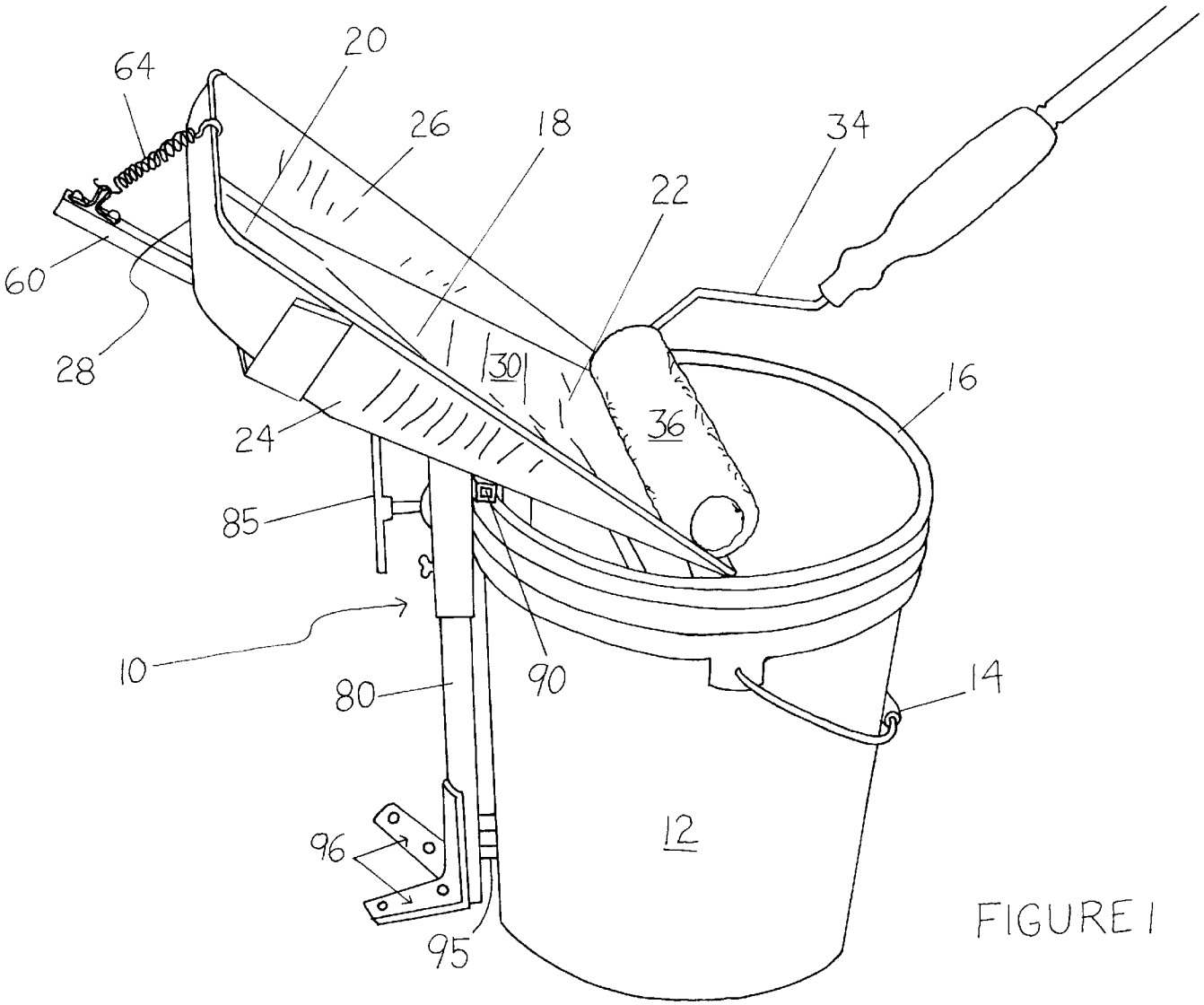
FIG. 1 is a perspective view showing the preferred embodiment of the bracket affixed to the paint bucket, the bracket further having a standard paint roller tray attached thereto, and a paint roller being used in concert with the invention.
Figure 2:
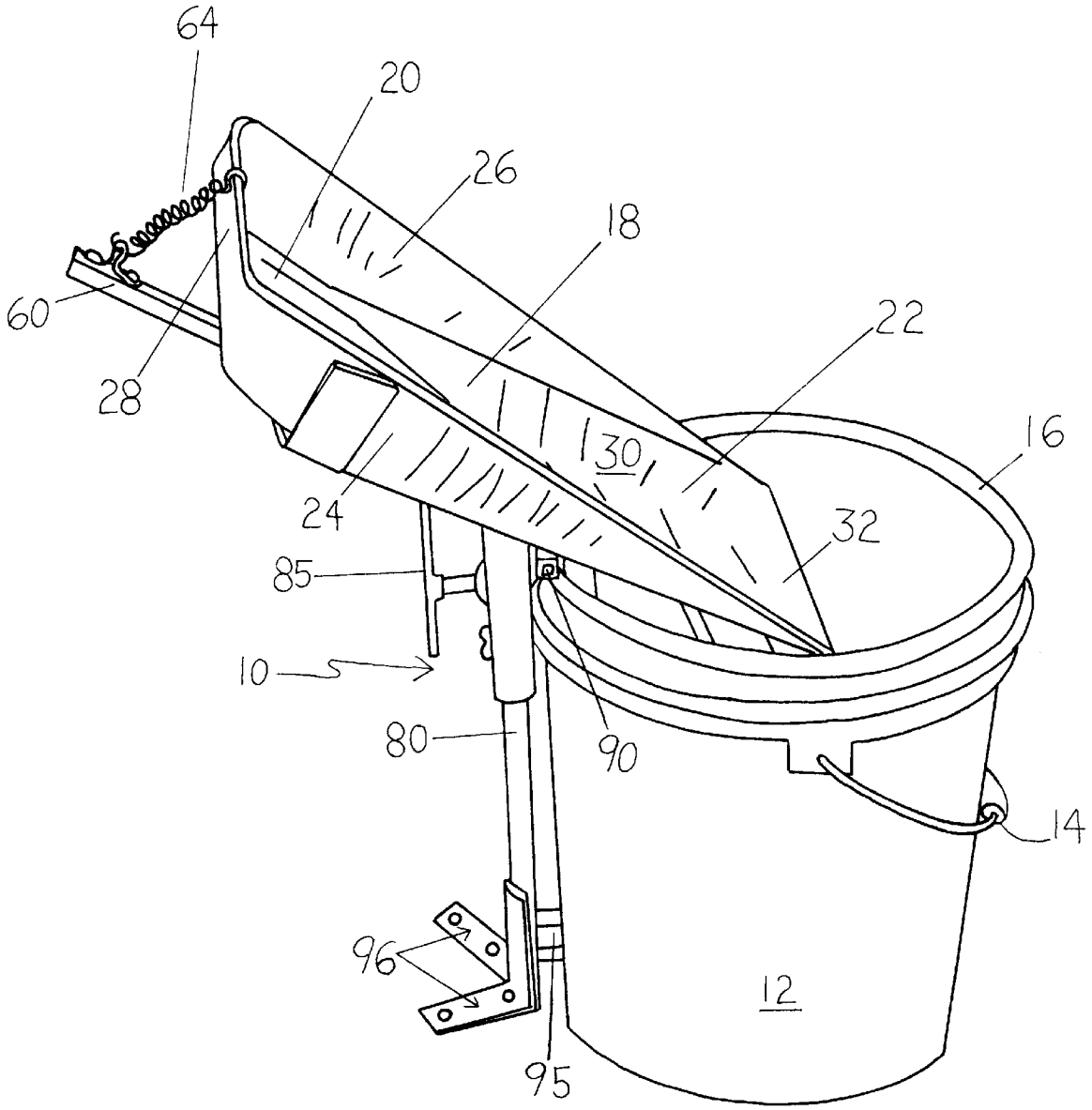
FIG. 2 is a perspective view showing the bracket affixed to the paint bucket with the bracket further having a standard paint roller tray attached thereto.
Figure 3:
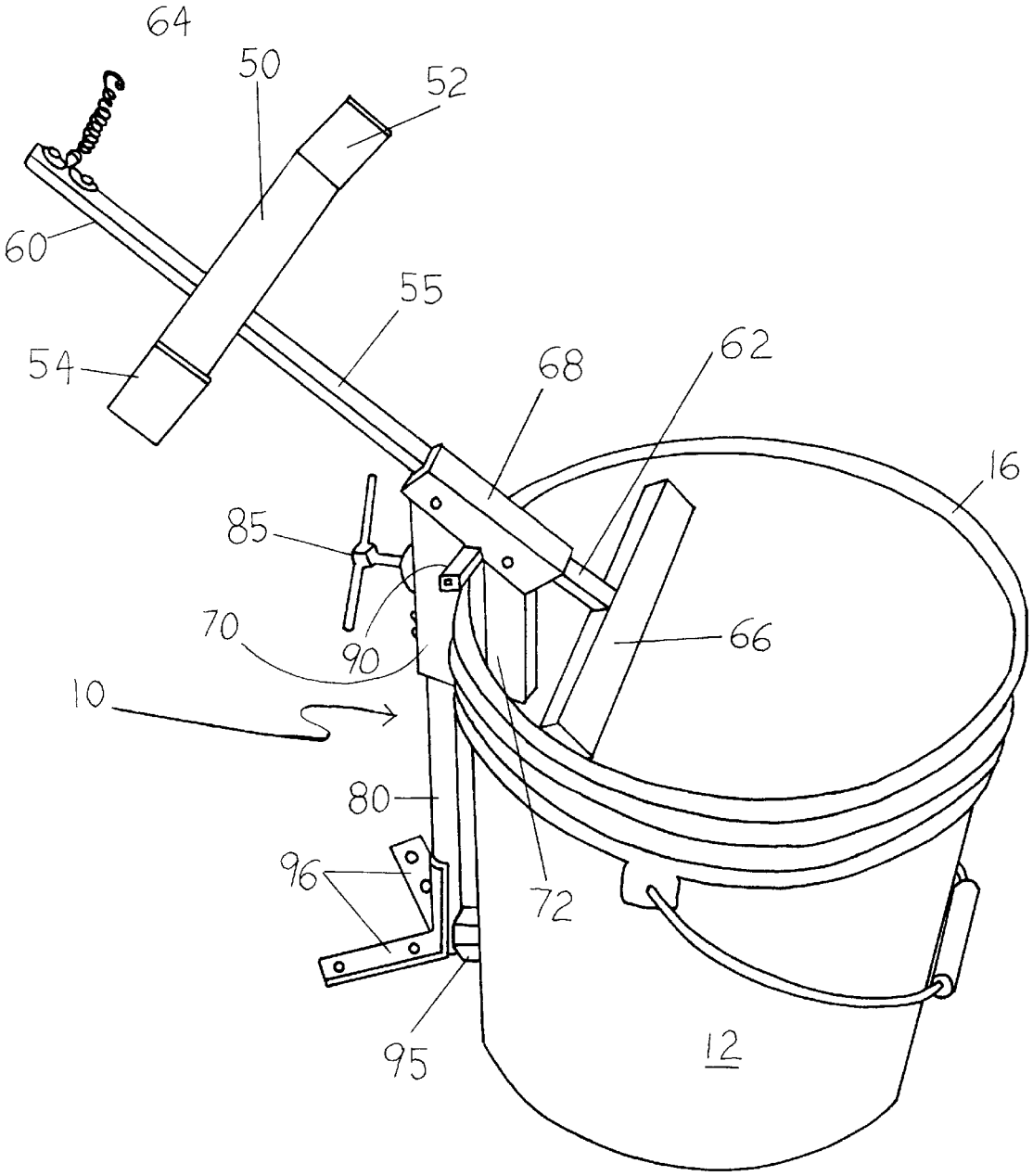
FIG. 3 is a perspective view showing the bracket affixed to the paint bucket.

Turning initially to FIGS. 1–4, there is shown a first exemplary embodiment of the bracket assembly for affixing a standard paint roller tray to a multi gallon paint bucket. The bracket is generally designated by reference numeral 10. The bracket 10 is shown affixed to a standard five gallon bucket 12. The standard five gallon bucket 12 is generally cylindrical and includes a handle 14 and a rim 16 which describes the upper perimeter of the opening of the bucket 12. The rim 16 forms a circular ring; within the bucket 12 resides coating, such as paint or sealant. Attached to the bracket 10 is a paint roller tray 18. The paint roller tray 18 has a generally upper portion 20 and a generally lower portion 22. The tray 18 includes a first sidewall 24, a second sidewall 26, a rearwall 28, a floor 30 and a front edge 32. The tray 18 is held within the bracket 10 in an angled relation above the bucket 12 with the upper portion 20 being higher than lower portion 22. The angle formed may be in the range of 5 to 60 degrees. This will permit residual paint to fall back into the bucket 12 over the front edge 32. A paint roller 34 is shown in FIG. 1 proximal the front edge 32 of the lower portion 22 of the paint roller tray 18. The paint roller 34 would be dipped in the paint located in the bucket 12. This action entrains paint about the roll 36 of the paint roller 34. Excess paint will be removed from the roll 36 by a rolling action, up and down on the floor 30 of the paint roller tray 18. The paint roller 34 will then be employed in its well known manner.

Figure 4:
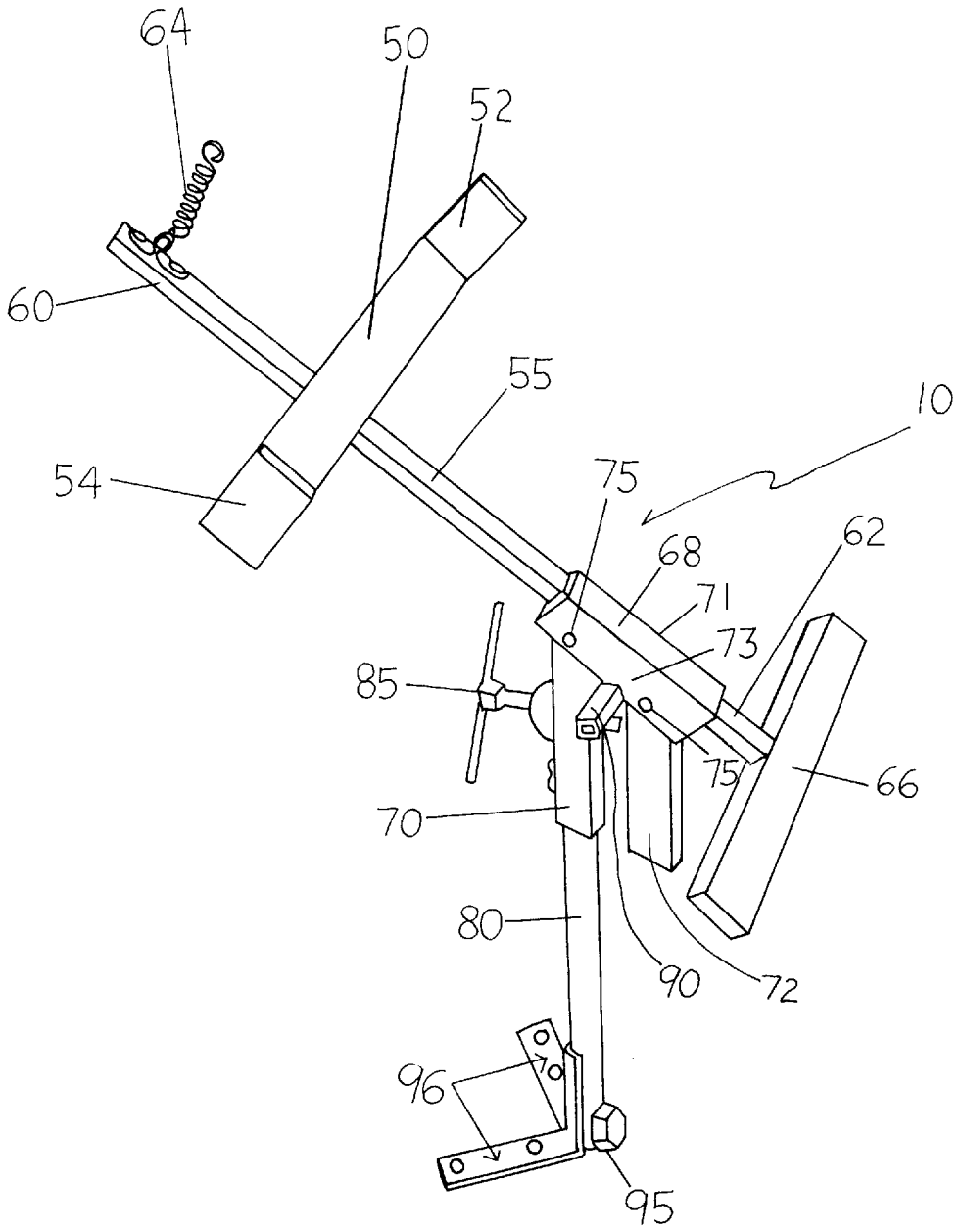
FIG. 4 is a perspective view of the bracket of the invention.

The bracket 10 is best seen in FIG. 4. The bracket 10 includes a cradle 50 for receiving a paint roller tray 18 in an angled relation above the bucket 12. The cradle 50 is centrally fixed atop a first rod 55, the first rod 55 having a top portion 60 and a bottom portion 62. The cradle 50 includes a first wing 52 and a second wing 54. The top portion 60 includes a flexible attachment element 64 to secure the paint tray to the cradle 50. The flexible attachment element 64 may be a spring-clip arrangement, or any other well known conventional fastening means. The bottom portion 62 includes a rectangular support element 66 which is affixed centrally and perpendicularly to the bottom portion 62 of the first rod 55. Intermediate the top portion 60 and the bottom portion 62 is an U-shaped cover 68 which is nested in a downward fashion atop the first rod 55. The cover 68 has a first leg 70 and a second leg 72 affixed thereto in parallel relation which straddle the rim 16 of the bucket 12. The cover 68 has a first lip 73 and a second lip 71 which nest atop the first rod 55. The first leg 70 and the second leg 72 depend downwardly from intermediate the two lips (71, 73) of the cover 68. The first leg 70 and second leg 72 are secured to within the two lips (71, 73) by conventional means 75. The first leg 70 remains outside the bucket 12, and has an extension element 80 depending therefrom. The extension element 80 is adjustable in height, and acts as a stabilization support for the bracket 10. The extension element 80 may be telescopically received within the first leg 70, or may be threaded into the first leg 70. The second leg 72 remains inside the bucket 12 and with the first leg 70 acts as a yoke about the rim 16. A securing element 85 is provided on the first leg 70, which fixes the bracket 10 to the bucket 12. The securing element 85 is received through the first leg 70, in a tapped hole designed to receive a threaded portion of the securing element 85. The securing element 85 may be screwed into the tapped hole, thus attaching the first leg 70 against the bucket, firmly affixing the bracket 10 thereto. By removing the securing element 85, the bracket may be taken off the bucket 12. A rectangular element 90 is located intermediate the first leg 70 and the second leg 72. The rectangular element 90 is designed to reside on the rim 16 of the bucket 12. The rectangular element 90 lies atop a portion of the arcuate surface of the rim 16, giving further support to the bracket 10. A spacer element 95 is provided on the bottom of the extension element 80 to bias the extension element 80 against the bucket. A pair of feet 96 depend from the bottom of the extension element 80 to provide stabilization against tipping when the bracket 10 is employed in its intended fashion.

Figures 5, 6:
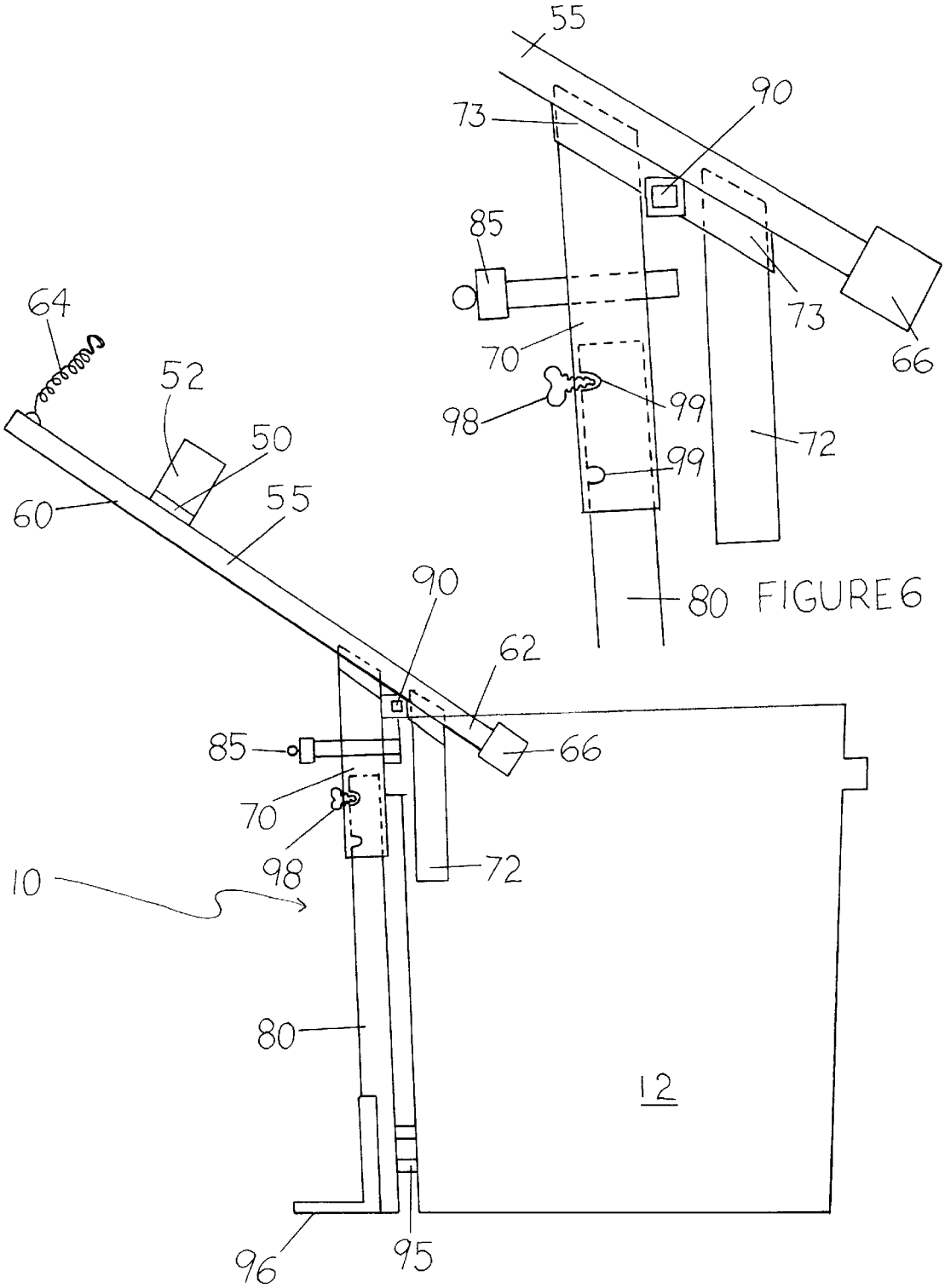
FIG. 5 is a cross-sectional view with detail showing the bracket affixed to the bucket.
FIG. 6 is an exploded view of the detail (mounting elements and ancillary structure) of the bracket.

Referring now to FIG. 5, a cut away view of the bracket 10 is shown. The specific arrangement of the securing element 85 is shown. Securing element 85 completely passes through first leg 70 and rests against the side of the bucket 12. Securing element 85 is threadably adjustable within a tapped hole in first leg 70. By rotation of the securing element 85, the bracket 10 may be secured to the bucket 12. By rotating the securing element 85 in the opposite direction, the bracket 10 may be removed from the bucket 12. Extension element 80 is shown being telescopically received in first leg 70. Conventional paint buckets 12 come in either 13 inch tall buckets or 14 inch tall buckets. Extension element 80 will have at least 2 settings, one for 13 inches and one for 14 inches. Locking means 98 are provided which will permit the extension element 80 to be at either the 13 inch or 14 inch position.

FIG. 6 refers specifically to the telescoping assembly between the first leg 70 and the extension element 80. Locking means 98 may be a screw, a spring loaded element or some other element. Locking means 98 may be retained in detents or threading 99 located on the upper portion of the extension element. Other embodiments may just permit a screw to be received in an aperture on the upper portion of the extension element 80. In still yet other embodiments the extension element may be rotatably received in a tapped hole in the bottom of the first leg 70. A sleeve may be present in the lower portion of the first leg 70 to permit an extension element with a smaller diameter or geometric configuration to be employed.

It has been considered that the bracket 10 may be designed to be made from plastic, metal or a combination of plastic and metal elements.

Use of the bracket 10 saves considerable time and permits complete utilization of the paint.

It is apparent from the above that the present invention accomplishes all of the objectives set forth by providing a bracket assembly for affixing a standard paint roller tray to a multi-gallon paint bucket which includes a cradle for holding the tray above the bucket in an angled relation which includes means to prevent the paint bucket from tipping over when being used.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A bracket for securing a paint roller tray to a paint bucket, the bucket having a circular lip, said bracket comprising, a cradle and a rod, said cradle fixed atop said rod, said rod having a top portion and a bottom portion, a support element, said support element attached to said bottom portion in a perpendicular fashion, a U-shaped element, said U-shaped element located intermediate said top portion and said bottom portion, said U-shaped element being placed atop said rod and receiving said rod within, said U-shaped element further having a pair of lips protruding downwardly about said rod, a first leg and a second leg, said first and second leg being received intermediate said pair of lips, and said first and second leg being further secured thereto in parallel relation, a gap, said gap located intermediate said first leg and said second leg, said first leg including a lower portion, said lower portion extending to the ground, whereby the paint roller tray is adapted to be received in said cradle, with said gap adapted to receive the lip of the bucket therein in such a fashion that said first leg is outside the bucket and said second leg is inside the bucket, and further said rod is oriented in an angled relation above the bucket, permitting a roller access to the bucket.

2. A bracket for securing a paint roller tray to a paint bucket as claimed in claim 1 wherein said first leg includes a pair of feet, said pair of feet coacting with the ground to give stabilization to said bracket.

3. A bracket for securing a paint roller tray to a paint bucket as claimed in claim 1 wherein said first leg is adjustable in height.

4. A bracket for securing a paint roller tray to a paint bucket as claimed in claim 3 wherein said first leg includes telescoping height adjustment means.

5. A bracket for securing a paint roller tray to a paint bucket as claimed in claim 3 wherein said first leg includes threading height adjustment means.

6. A bracket for securing a paint roller tray to a paint bucket, the bucket having a circular lip, said bracket comprising, a cradle and a rod, said cradle fixed atop said rod, said rod having a top portion and a bottom portion, a support element, said support element attached to said bottom portion in a perpendicular fashion, a U-shaped element, said U-shaped element located intermediate said top portion and said bottom portion, said U-shaped element being placed atop said rod and receiving said rod within, said U-shaped element further having a pair of lips protruding downwardly about said rod, a first leg and a second leg, said first and second leg being received intermediate said pair of lips, and said first and second leg being further secured thereto in parallel relation, a gap, said gap located intermediate said first leg and said second leg, said gap capable of receiving the lip of the said bucket therein, said first leg being outside said bucket and said second leg being inside said bucket, said first leg including a lower portion, said lower portion extending to the ground, whereby the paint roller tray is adapted to be received in said cradle, and said rod is oriented in an angled relation above said bucket, permitting a roller access to said bucket.

7. A bracket for securing a paint roller tray to a paint bucket as claimed in claim 6 wherein said first leg includes a pair of feet, said pair of feet coacting with the ground to give stabilization to said bracket.

8. A bracket for securing a paint roller tray to a paint bucket as claimed in claim 6 wherein said first leg is adjustable in height.

9. A bracket for securing a paint roller tray to a paint bucket as claimed in claim 6 wherein said first leg includes telescoping height adjustment means.

10. A bracket for securing a paint roller tray to a paint bucket as claimed in claim 6 wherein said first leg includes threading height adjustment means.

* * * * *